United States Patent [19]

Saito et al.

[11] 4,106,929

[45] Aug. 15, 1978

[54] PROCESS FOR PREPARING A FERROCHROMIUM BY USING A BLAST FURNACE

[75] Inventors: Tamekazu Saito; Mithunobu Tanaka; Yutaka Saito; Kenich Sakaue, all of Chichibu, Japan

[73] Assignee: Showa Denko Kabushiki Kaisha, Tokyo, Japan

[21] Appl. No.: 857,857

[22] Filed: Dec. 6, 1977

[30] Foreign Application Priority Data

Dec. 10, 1976 [JP] Japan ..... 51-148452

[51] Int. Cl.[2] ..... C22C 39/14

[52] U.S. Cl. ..... 75/130.5; 75/3; 75/42

[58] Field of Search ..... 75/41, 42, 21, 3, 130.5

[56] References Cited

U.S. PATENT DOCUMENTS

| | | | |
|---|---|---|---|
| 2,238,078 | 4/1941 | Royster | 75/130.5 |
| 2,286,577 | 6/1942 | Royster | 75/130.5 |
| 3,198,624 | 8/1965 | Bell et al. | 75/130.5 |
| 3,336,132 | 8/1967 | McCoy | 75/41 |
| 3,607,247 | 9/1971 | McCoy | 75/130.5 |

*Primary Examiner*—M. J. Andrews

*Attorney, Agent, or Firm*—Armstrong, Nikaido, Marmelstein & Kubovcik

[57] ABSTRACT

The process for preparing a ferrochromium by using a blast furnace is improved by charging briquettes or pellets containing chromium ores and a carbonaceous reducing agent into the blast furnace, as well as by determining the operational conditions of the blast furnace, such as the theoretical combustion temperature at the tuyere ends and the pressure at the top of the blast furnace. According to the improvement, the degree of reduction chromium ore is high, and the blast furnace operation can smoothly performed without accidents, such as scaffolding and flooding.

4 Claims, 2 Drawing Figures

PROCESS FOR PREPARING A FERROCHROMIUM BY USING A BLAST FURNACE

Figure 1:
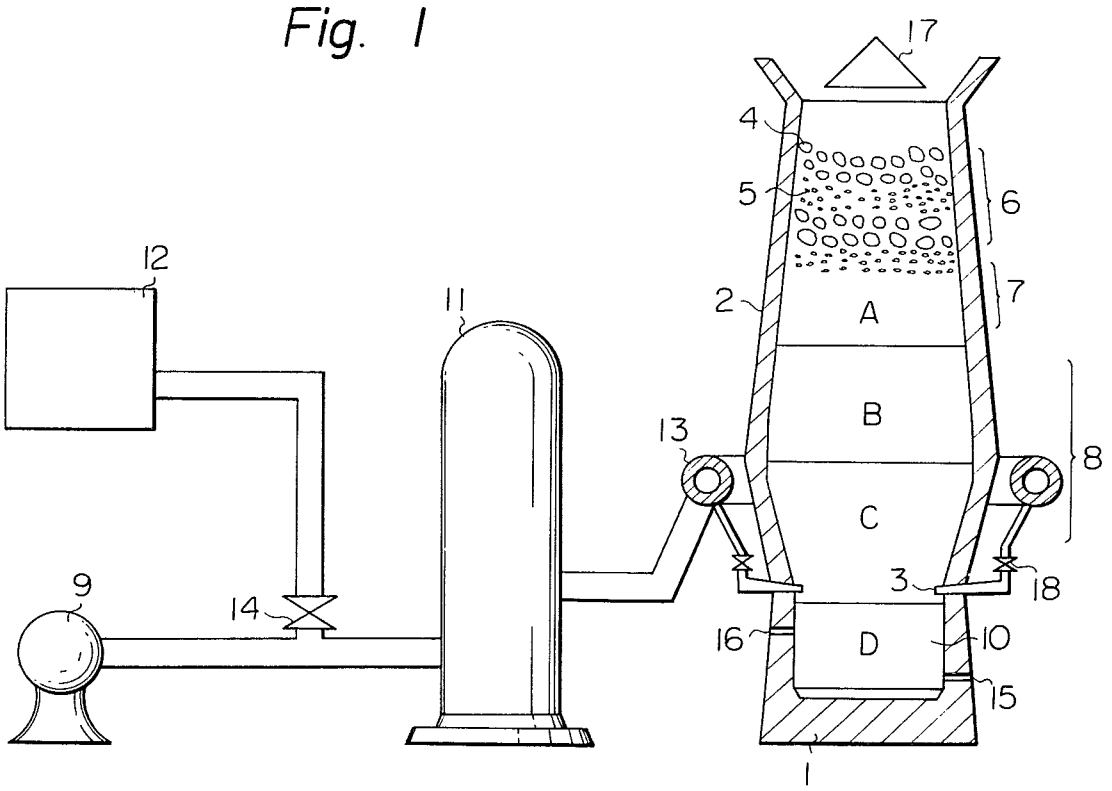

The present invention relates to a process for preparing a ferrochromium, and particularly, a process for preparing a ferrochromium by using a blast furnace.

In general, ferrochromium is prepared by charging a chromium ore, a reducing agent such as coke and a slag-forming material such as lime in an electric furnace and smelting in the electric furnace. In this process, a heavy investment must be made in equipments such as transformers and electrode devices and high skill and experience are required for smelting. The most serious defect of this process is that expensive electrical energy must be used.

With increasing demand for the saving of energy, various improvmenets have recently been proposed in this electric furnace process and some of them have been industrialized in Japan. For example, according to one of such proposals, a chromium ore is treated in a rotary kiln or the like so as to partially reduce the iron and chromium oxides in the chromium ore in the solid state before the chromium ore is charged in an electric furnace. Then, the partially reduced chromium ore is charged in the electric furnace and the reaction is completed to obtain ferrochromium. This rotary kiln process is advantageous in that a part of the electrical energy is replaced by cheap energy of heavy oil or the like. However, in order to perform this partial reduction on an industrial scale, a rotary kiln or shaft kiln having therein a combustion flame of heavy oil or the like has to be used and formation of a certain oxidizing atmosphere in a furnace of the rotary kiln or the like cannot be avoided. Accordingly, there arises a problem of re-oxidation of once reduced iron or chromium. When a rotary kiln or the like is used, it is difficult to increase the reduction rate of chromium oxide in the solid phase under atmospheric pressure. Because of this difficulty, in addition to the above problem of re-oxidation, the reduction ratio of the chromium ore in the rotary kiln or the like is about 70% at highest. Therefore, the partially reduced pellets or briquettes are charged into an electric furnace and the smelting operation must be conducted. Further, this process involves difficulties also in connection with equipment. Namely, a rotary kiln and accessory equipment must be provided in addition to equipment of the smelting process using an electric furnace alone. In order to utilize heat effectively, the reduced pellets are charged in the electric furnace while they are maintained at a high temperature, and in order to prevent re-oxidation at such high temperature, and subsequent fusion and adhesion, it is necessary to seal the storing and transferring devices and make other troublesome arrangements.

Processes for preparing ferrochromium in blast furnaces have heretofore been proposed in some patent specifications, but these processes have not been worked on an industrial scale.

For example, in the process disclosed in the specification of U.S. Pat. No. 2,238,078, by heating blast blown into a blast furnace at a temperature higher than 1800° F. (about 980° C) to sufficiently liquefy ore particles in the vicinity of the tuyeres, it is intended to greatly advance the reaction between the liquefied ore and carbon and reduce $Cr_2O_3$ to Cr.

Since the blast temperature as disclosed in the abovementioned U.S. patent specification was difficult to attain in a blast furnace plant in the early days, the specification of U.S. Pat. No. 2,286,577 proposed a process in which in the first stage a chromium ore is liquefied in a blast furnace, and the melt is solidified and smelting is completed in the second stage.

In the foregoing two processes, since a blast furnace is employed, needless to say, a lumpy ore is charged. The reason these processes have not been practically industrialized is that sufficient measures were not taken to meet peculiar problems owing to the difference of the reduction mechanism between a chromium ore and an iron ore, and as a result, a sufficient degree of reduction of chromium oxide cannot be attained. In the latter process, completion of smelting by the treatment in the blast furnace is deemed to be impossible.

In reduction of an iron ore, indirect reduction with CO and $H_2$ is advanced to a considerably high level in the region where the iron ore is in the solid phase. This indirect reduction takes place in the upper portion of the blast furnace. Accordingly, the considerably reduced iron ore is introduced into a high temperature region of the blast furnace. In this high temperature region, the reduction of remaining the iron oxide and the melting are caused. Namely, in the case of an iron ore, the main reduction in the upper portion of the blast furnace is advanced in the state well-balanced with melting taking place in the lower portion of the blast furnace. Therefore, the burden materials fall down smoothly in the blast furnace. Moreover, the melting points of the iron ore and pig iron are relatively low. Accordingly, an iron ore can be smelted sufficiently in the blast furnace.

In the case of a chromium ore, however, such sufficient smelting cannot be expected in the blast furnace. The main component of a chromium ore is $Cr_2O_3$ and the Cr/Fe weight ratio in the ore is ordinarily in the range of 1.5 to 3.5 and the chromium content is much higher than the iron content. Moreover, $Cr_2O_3$ is difficultly reducible and almost no indirect reduction with CO gas or the like is caused in the blast furnace. Accordingly, when a chromium ore and lumpy coke are charged, even if a part of iron oxide in the ore is indirectly reduced, almost no indirect reduction of the chromium ore as a whole is caused.

In the blast furnace, the upper portion is a solid phase-gas phase region, the intermediate portion is a region where the solid phase, liquid phase and gas phase are co-present, and the lower portion is a solid phase (coke or the like)-liquid phase region. As pointed out hereinbefore, the chromium ore is not sufficiently reduced in the solid phase-gas phase region and it is introduced in a substantially unreduced state into the solid phase-liquid phase-gas phase region, and then, the solid phase-liquid phase region. In these regions, the contact between the carbonaceous reducing agent and ore is insufficient, and hence, a considerable portion of the ore is not sufficiently reacted and is left in the form of a slag. Further, in the smelting of ferrochromium from a chromium ore, a much larger amount of a slag is formed than in the case of smelting pig iron from an iron ore. Therefore, the contact between the unreacted chromium ore and carbonaceous reducing agent is not sufficiently conducted, and hence, it is very difficult to perform the reducing reaction in the liquid phase at a high degree.

Still further, since the melting point of $Cr_2O_3$ is very high, if unreacted $Cr_2O_3$ is present in a slag, the melting point of the slag is drastically elevated. Accordingly, separation of ferrochromium metal from the slag and recovery of ferrochromium metal from the slag becomes very difficult.

For the above-mentioned reasons, if only a chromium ore and lumpy coke are charged in a blast furnace, the balance between the reducing reaction and metling is lost and the unreacted melt becomes excessive, with the result that smelting cannot be advanced smoothly.

Even if the blast temperature is elevated to a level much higher than the level attainable at the time of the filling of the above-mentioned U.S. Pat. No. 2,238,078, the above problems involved in the blast furnace smelting of ferrochromium cannot be solved.

It is an object of the present invention to provide a process for preparing a ferrochromium using a blast furnace, in which the smelting of the ferrochromium from a chromium ore is advanced smoothly at a high degree of reduction of the ferrochromium ores.

It is another object of the present invention to provide a process for preparing a ferrochromium, which contains chromium in an amount of 40% or more, preferably 50% or more. This ferrochromium should be produced at a high yield of 90% or more, preferably 95% or more, based on the chromium amount in the chromium ores.

It is still another object of the present invention to provide a process for producing a ferrochromium in a blast furnace, in which the operation in performed without problems, such as scaffolding or poor permeability.

The Inventors aim to achieve both a considerable decrease of energy consumption by changing over the energy source from electricity to coke and the simplification of the process steps. Since the blast furnace smelting of the ferrochromium from a chromium ore was attractive in view of the aim mentioned above, the Inventors, therefore, conducted various research projects and investigations on this smelting process. As a result, the Inventors have now completed the present invention.

According to one feature of the present invention, a ferrochromium metal and a slag are formed, by forming an agglomerate of a mixture of a powder of a chromium ore and a powder of a carbonaceous reducing agent, charging this agglomerate and lumpy coke into a blast furnace and blowing a preheated, oxygen-containing gas from the tuyeres of the blast furnace.

The so called briquettes and pellets are collectively referred to as agglomerate in this specification.

According to another feature of the present invention, an appropriate relationship between the charging of the starting materials and the temperature control is established. More specifically, the ratio of the carbonaceous agent in the agglomerate and theoretical combustion temperature at the tuyere end determined by the preheated, oxygen-containing gas, are set so that: (a) said agglomerate is not substantially powderized in the blast furnace, and; (b) chromium oxide in the chromium ore is partially reduced in an upper region of the blast furnace, where said agglomerate is in the solid phase, and then, the chromium oxide in the chromium ore is esentially reduced in a lower region of the blast furnace where said agglomerate is in the liquid phase.

The process according to the present invention will now be described in detail.

According to the process of the present invention, agglomerates are first prepared from a powder of a chromium ore and a powder of carbonaceous material. Chromium ores are ordinarily produced in the lumpy state or the powdery state. In the former case, the lumpy ore is first pulverized or powderized and the resulting powdery ore is used for preparing the above-mentioned agglomerates. Chromium ores having a Cr/Fe ratio of 1.5 to 3.5, which have been customarily used in smelting in an electric furnace or the like are used in the present invention, but the Cr/Fe ratio in the starting ore is not limited to the above range in the present invention. A typical instance of the composition (% by weight) of the chromium ore is as follows:

$Cr_2O_3$ : 44.6
FeO : 18.8
$Al_2O_3$ : 13.0
MgO : 9.7
$SiO_2$ : 7.3
CaO : trace It is preferred that the particle size of the powdery chromium ore be 45 mesh or finer, especially 150 mesh or finer.

The carbonaceous powder is used as a reducing agent and participates in solid phase reduction in the upper portion of the blast furnace. In the case of an iron ore, as pointed out hereinbefore, gas phase reduction is advanced considerably, and charging of powdery carbonaceous material in the state incorporated in agglomerates, such as mentioned above, is of almost no significance. As the carbonaceous material, in the present invention, there are used known products such as coal, coke, petroleum coke and calcined anthracite coal. It is preferred that the particle size of the carbonaceous material in the form of a powder be 45 mesh or finer, especially 150 mesh or finer.

The powdery, chromium ore and carbonaceous material are well mixed. Of course, it is possible to adopt a method in which lumps of a chromium ore and lumps of carbonaceous material are first mixed sufficiently and the mixture is then pulverized.

The ratio of carbonaceous material to the chromium ore has influences on not only the strength of the agglomerate but also reduction of the agglomerates in the blast furnace.

In order to determine the ratio of carbonaceous material from the view point of reduction, it is necessary to examine the reaction formula of a chromium ore with carbon. This reaction includes various modes. In the present invention, the following reaction formulas are assumed as representing the main reactions and the theoretical amount of carbon is calculated from these formulas.

$$7Cr_2O_3 + 27C \rightarrow 2Cr_7C_3 + 21CO \quad (1)$$

$$7FeO + 10C \rightarrow Fe_7C_3 + 7CO \quad (2)$$

For the reaction of the formula (1), 27 moles of carbon are necessary for 14 moles of Cr. Namely, 27/14 moles of carbon are necessary per mole of Cr and if expressed on a weight basis, about 0.45 kg of carbon is necessary per kg of Cr. Similarly, for the reaction of the formula (2), 10/7 moles of carbon are necessary per mole of Fe and if expressed on a weight basis, about 0.31 kg of carbon are necessary per kg of iron.

The reduction of the formula (2) proceeds preferentially to the reduction of the formula (1), but it is not true that the reduction of the formula (1) starts after completion of the reduction of the formula (2). There is a certain equilibrium relationship between the reductions of both of the formulae. Accordingly, even if the amount of carbon is equal to the theoretical amount defined by the formula (2), or less than this theoretical amount, the reaction of the formula (1) will be advanced to some extent. Therefore, the minimum amount of carbon in the agglomerate should exceed the theoretical amount defined by the formula (2). Since a part of carbon is burnt in the blast furnace, the maximum amount of carbon may be larger than the sum of the theoretical amounts defined by the formulas (1) and (2). In the present invention, however, since the carbon-containing agglomerates are charged into the blast furnace without reinforcing them by heating, the maximum amount of carbon must be set. In general, the maximum amount of carbon in the agglomerate is 1.2 times the sum of the theoretical amounts defined by the above formulas (1) and (2), and preferably is equal to the theoretical amount mentioned above, although the maximum carbon amount differs depending on the size of the blast furnace. If the content of carbon in the agglomerate exceeds this maximum amount, the strength of the agglomerate is reduced and problems are caused in the blast furnace. In other words, if the carbon content is adjusted below said maximum amount, the operation in the blast furnace can be performed without any trouble. When coal, coke or the like is used as the powdery carbonaceous material, the carbon in each of the formulae (1) and (2) is, of course, fixed carbon.

The minimum amount of the carbon is in aggreement with the theoretical amount defined by the formula (1), so that at least 80% of $Cr_2O_3$ is reduced until the chromium ore is falled down to the upper portion of the softening zone of the blast furnace, as illustrated later.

In order to prepare the agglomerates from a mixture of the above-mentioned powders, at least one member selected from inorganic binders such as bentonite, water glass and cement, and organic binders such as starch, CMC (carboxymethyl cellulose) and PVA (polyvinyl alcohol), is incorporated into the mixture, and the resulting mixture is molded into granules by a pelletizer or the like or formed into lumps by a briquette machine, an extruder or the like. The shape of the agglomerate is not particularly limited to a spherical shape.

It is preferred that the size of the agglomerates be in the range of from 10 to 50 mm, so as to ensure the agglomerates will be liquified and then dropped. Further, in order to attain good permeability among the packed particles of the agglomerates, it is preferred that the size of the agglomerates be uniform in the above range, so that excessively dense packing is prevented.

Green agglomerates formed by granulation or the like are then dried or cured (when cement is used as the binder). This drying may be accomplished in the burden material-preheating zone in the upper portion of the blast furnace, but in the case where agglomerates having high strength are especially desired or some special binder is employed, it is preferred that a drying zone be disposed separately and the agglomerates be dried in advance in this drying process. In this case, drying is carried out at a temperature at which carbonaceous material is not substantially burnt, namely below 500° C. A known grate kiln or the like can be used as the drying apparatus.

As in the case of the smelting of pig iron from an iron ore, it is preferred that the strength of lumpy coke to be charged in the blast furnace together with the lumpy ore and the sintered ore be high. However, since indirect reduction occurring in smelting of pig iron from an iron ore does not take place in the present invention, and thus the height of the blast furnace need not be increased, the strength condition of the lumpy coke is not so severe as in the smelting of pig iron from an iron ore. The size of lumpy coke is not particularly critical and is changed according the size of the blast furnace, but in general, it is preferred that the size of the lumpy coke be 10 to 100 mm and that the size be uniform in this range. The amount of the lumpy coke is preferably about 150 to about 500 kg per ton of the agglomerates although the preferred amount of the lumpy coke is varied to some extent depending on the carbon content in the agglomerates.

Lime (quick lime or limestone) is mainly used as the slag-forming material, and in some cases, silica may be added as the slag-forming material. Additives customarily used in electric furnace smelting of the ferrochromium from a chromium ore for increasing the fluidity of the slag or promoting solid phase reduction at the pre-reduction step in a rotary kiln, such as fluorides and carbonates of alkali metals or alkaline earth metals, may be incorporated into the slag-forming material. Further, lime, silica and such additives as above-mentioned may be incorporated into the above-mentioned agglomerates. Namely, the slag-forming material(s) is charged separately from the agglomerates or is charged in a state incorporated in the agglomerate, or both the charging methods are adopted in combination. In the case of the electric furnace smelting, the composition of the slag-formed material is strictly limited because this composition influences the electrical resistance. In the process of the present invention, however, the composition of the slag-forming material is determined after due consideration of the viscosity and melting point of the resulting slag. It is preferred that the composition of the slag-forming material be determined so that the $CaO/SiO_2$ ratio (hereinafter referred to as "C/S ratio") in the resulting slag is in the range of from 0.4 to 1.3, and the $(Al_2O_3 + MgO)/(CaO + SiO_2 + MgO + Al_2O_3)$ ratio (hereinafter referred to as "AMF") in the resulting slag is in the range of from 0.4 to 0.8. If AMF is lower than 0.4, the volume of the slag is increased and the sensible heat taken out by the slag is increased, and contacts among the effective components (carbon, chromium oxide and iron oxide) are adversely influenced and good effects are not attained with respect to promotion of the reaction. When AMF is higher than 0.8, the melting point of the slag becomes high and the fluidity of the melt is degraded, and a problem arises in connection with the separation of the metal from the slag. The C/S ratio is selected so that a slag having a low melting point and a low viscosity is formed, and in general, it is preferred that the C/S ratio be in the range of from 0.4 to 1.3.

According to the present invention, the blast furnace operation can be satisfactorily performed by using slag essentially consisting of CaO, $SiO_2$, $Al_2O_3$, MgO, and less than 5% of $Cr_2O_3$.

The control of the temperature in the blast furnace will now be described. This temperature control is one of the important requirements of the present invention. In general, the temperature control is performed based on the theoretical combustion temperature at the tuyere end, which will be hereinafter referred to as "temperature in the combustion zone". The temperature in the combustion zone is determined by the temperature of blast and moisture content of the air, and when oxygen-enriched air is used, the temperature in the combustion zone is determined by the oxygen enrichment ratio, in addition to the temperature of the blast and the moisture content of air. The temperature in the combustion zone corresponds to the maximum temperature in the combustion zone. The temperature in the combustion zone is calculated by the following formula of Ramm.

$$Tgas = \frac{36.7 + Tblast[0.3605 + 0.595W + 0.0225(O_2)] - 1728W + 2297(O_2)}{0.386 + 0.015(O_2) + 0.716W}$$

wherein *Tblast* represents the temperature (° C) of the blast, *W* denotes of the moisture content (kg) in 1 $m^3$ of air, and $(O_2)$ stands for the oxygen gas volume ratio in the blast.

The blast is a gas selected from the group consisting of an air and an oxygen-enriched air.

The temperature in the combustion zone is a heat source for completing reduction of chromium oxide and finally forming a molten slag and a high-temperature melt of ferrochromium, and this temperature should naturally be high. However, if the temperature in the combustion zone is too high, various problems are caused. As a result of experiments conducted by the Inventors, a preferred temperature in the combustion zone in the present invention is in the range of approximately 2000° to approximately 2600° C. When the temperature in the combustion zone is lower than 2000° C, sufficient heat is not supplied and the fluidity of the melt is insufficient, and when the temperature in the combustion zone exceeds 2600° C, formation of vapors becomes conspicuous and these vapors are oxidized on the surface of lumpy coke, resulting in formation of silica adhering to the coke and causing cohesion of the lumpy coke pieces to each other at the surfaces thereof. Accordingly, so-called scaffolding is caused and other operational problems, such as corrosion of the refractory lining in the furnace, are brought about. The temperature in the combustion zone is determined by the above-mentioned three variables, Tblast, W and $(O_2)$. These three variables are appropriately chosen so that the temperature in the combustion zone is maintained at a desirable level. From the practical viewpoint, air having a blast temperature (Tblast) of from 200° to 1200° C is preferably employed. If oxygen-enriched air is used, it is preferred that the oxygen content be lower than 41% by volume and the moisture content be 3 to 50 $g/m^3$.

According to the present invention, all or essentially all of the chromium ore is charged in the blast furnace in the form of briquettes without causing problems in the blast furnace operation. The amount of hot blast is set at from 10 to 30, per one $m^2$ of cross-sectional area of the blast furnace at the level of the tuyeres. The amount of the hot blast air exerts an influence on the atmosphere within the blast furnace and increases or decreases the amount of the reducing gas. However, since almost no indirect reduction of the chromium ores takes place, the increase or decrease of the reducing gas amount is not meaningful in the reduction of the chromium ores. The aim of supplying the hot blast air in the present invention is to adjust the temperature in the blast furnace, so that the reduction of the chromium ore is advanced enough at a level of the blast furnace corresponding to the softening region. When the amount of the hot blast is less than 10 $m^3/min/m^2$, the desired temperature distribution is not obtained in the blast furnace. On the other hand, when the amount mentioned above exceeds 30 $m^3/min/m^2$, the upward movement of the agglomerates and other charged raw materials occurs, with the result that it is impossible to suitably operate the blast furnace.

The hot blast blown into the blast furnace exerts a great affect on the caloric quantity, which quantity is required for both the melting of the charged materials and the reaction between the components of the charged materials. In order to increase the production rate of the blast furnace, the volume of the hot blast (the caloric quantity) should therefore be increased. As the amount of the hot blast is increased the speed of the blast becomes faster.

In the case of the iron ore reduction, when the gas speed is increased within such a range so as to not cause the well-known disadvantage of flooding, the reducing reaction rate and the production rates are correspondingly increased. This increase of the reducing reaction rate is due to the indirect reduction of the iron ores being carried out to a considerable extent. However, because the direct reduction is most predominant, in the reduction of the chromium ores, the melting of the chromium ore and the reducing reaction rate is not acelerated, in accordance with the increase of the gas speed. Therefore, in the reduction of chromium ore it is not effective to increase the volume of the hot blast to an amount exceeding the required thermal amount in order to elevate the production rate.

In addition, due to the direct reduction of the chromium ores, the CO gas is generated and increases by approximately 20% of the total amount of the gases. This generated gas is heated and caused to expend by the combustion of coke. As is stated above, the expansion of the gas volume and the increase of the gas amount are caused during the reduction of the chromium ores within the blast furnace.

Both processes also bring about the same effect as that produced by the increase of the blast volume. Accordingly, the increase of the blast volume might inconveniently cause the disadvantage mentioned above.

For the foregoing reasons, in order to transfer more caloric quantity to the materials already charged into the blast furnace, the operation should not be carried out at a higher blast volume, but should be carried out at a higher gas pressure within the blast furnace. This pressure should be from 1 to 3 $kg/cm^2$ in terms of the absolute pressure measured at the top of the blast furnace.

If a high pressure is utilized for the blast furnace operation, it is easier for gas in the furnace to pass through the spaces located between the burden materials in the furnace. Due to this condition, it is therefore, possible to reduce the size of the agglomerates used, and to operate the blast furnace even when a part of the agglomerates is broken. As is stated hereinafter, since reduction of chromium oxide is mainly a result of direct reduction, the chromium ores must travel within the furnace down to the softening region. Accordingly, the high pressure operation can ensure good permeability of gas even when the chromium ores are broken during this downward movement. The relatively sudden liquefaction of the chromium ores in the softening region can reduce such permeability in the blast furnace. However, the high pressure operation provides for a satisfactory operation of the blast furnace during the chromium ore reduction.

One of the preferred processes for producing ferrochromium according to the present invention comprises the steps of:

charging in a blast furnace (a) agglomerates containing a powder of chromium ore and a powder of carbonaceous reducing agent and (b) lumpy coke, the ratio of the carbonaceous material in the agglomerate being set so that the minimum value of the ratio is in agreement with the amount necessary for reducing an iron oxide in the chromium ore according to the formula.

$$7\,FeO + 10C \rightarrow Fe_7C_3 + 7CO$$

and the maximum value of said ratio is 1.2 times the amount necessary for reducing iron oxide and chromium oxide in the chromium ore according to the formulae.

$$7Cr_2O_3 + 27C \rightarrow 2Cr_7C_3 + 21CO$$

$$7FeO + 10C \rightarrow Fe_7C_3 + 7CO,$$

the slag-forming composition in the charged materials being such that, the ratio of $$\frac{\text{CaO (by weight \%) in the slag}}{\text{SiO}_2\text{(by weight \%) in the slag}}$$

ranges from 0.4 to 1.3, and further, the ratio of $$\frac{Al_2O_3(\%\text{ by weight}) + MgO(\%\text{ by weight})}{CaO(\%\text{ by weight}) + SiO_2(\%\text{ by weight}) + MgO(\%\text{ by weight}) + Al_2O_3(\%\text{ by weight})}$$

ranges from 0.4 to 0.8;

adjusting the gas pressure at the top of the blast furnace to a high pressure of from 1 to 3 kg/cm$^2$, thereby reducing the chromium ore to a chromium carbide by said carbonaceous material, at a reduction degree of more than 80% at a region of the blast furnace where the chromium ore is softened;

melting and dropping the reduced chromium carbide from the softening region to a hearth of the blast furnace; and obtaining the ferrochromium containing more than 40% by weight of chromium and slag containing less than 5% of $Cr_2O_3$ from the hearth.

Figure 2:
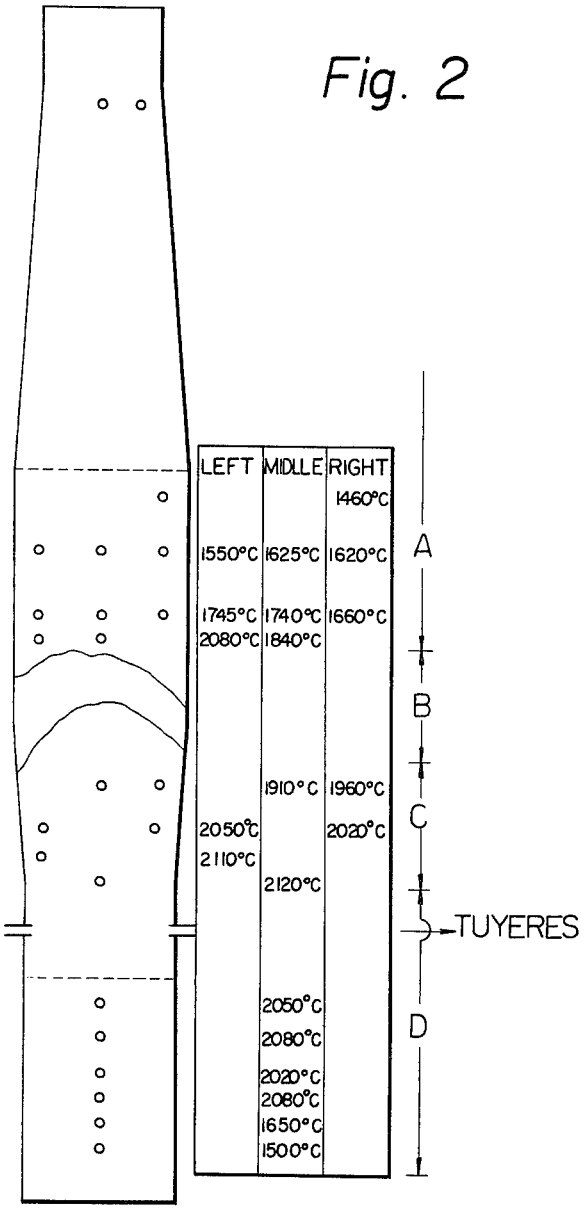

One embodiment of the operation according to the present invention will now be described with reference to the accompanying drawings, wherein:

FIG. 1 illustrates a longitudinal section of a blast furnace used in experiments of smelting according to the present invention; and FIG. 2 is a schematic cross-sectional view of the blast furnace for illustrating the temperature of and sampling positions from the blast furnace.

The blast furnace is a vertical reaction column, similar to one for use in smelting of an iron ore, in which an internal reaction space is defined by a hearth 1 and a side wall 2. In the lower portion of the furnace, tuyeres 3 are equidistantly distributed on the outer periphery of the furnace wall. The hearth may be composed of for example, carbon, graphite bricks or silicon carbide bricks, and the side wall may be composed of refractory bricks of the magnesia, alumina or chammote type. The length of the side wall relative to the greatest inner diameter may be smaller than in the furnace for an iron ore.

The burden materials are charged according to a method known in the manufacture of pig iron. More specifically, as shown in FIG. 1, the starting materials are charged layer by layer. The reason for this is that, since the size of agglomerate 5 is ordinarily different than the size of the lumpy coke 4, if they are mixed, dense packing is caused and air permeability of the gas is decreased. The agglomerates or lumpy coke is uniformly sized as much as possible by sieving or the like, but some dispersion of the size is unavoidable. In the blast furnace, permeability of the gas in the peripheral portion is higher than in the central portion. Accordingly, it is preferred to uniformly flow the gas by utilizing the above dispersion of the size. Namely, it is preferred that the agglomerate or coke having a smaller particle size be packed in the peripheral portion of the blast furnace. For this purpose, a known bell type charging device is suitable.

The tuyeres 3 are connected to a wind box 13 so that air received from a preheater 11 is uniformly distributed around the furnace. The regenerator type preheater 11 is connected to a blower 9 and to an oxygen tank 12 through a valve 14. When the operation is conducted by adjusting the temperature in the combustion zone by using the oxygen tank 12 and preheater 11, substantially all of the chromium and iron components in the ore are reduced and allowed to fall in a melt reservoir 10. Gangue in the chromium ore and the slag-forming material are molten and stored on the metal layer in the melt reservoir 10. In this manner, the reduction and melting are advanced smoothly, and with advance of the reaction, the starting material layers naturally fall down, and fresh starting materials are charged in proportion to this falling of the starting material layers. When certain amounts of the slag and metal are stored, they are discharged from slag tap hole 16 and metal tap hole 15. The yield of chromium is advantageously as high as 90% or more. Namely, 90% or more of chromium in the starting ore is recovered in the metal layer. The $Cr_2O_3$ content in the slag is lower than 5%.

A topmost region 6 in FIG. 1 is an indirect reduction region where the solid phase and the gas phase are co-present. In this region, a part of the iron oxide in the chromium ore is reduced by CO gas rising from the lower layer of the blast furnace. However, since the content of iron oxide in the chromium ore is low and iron oxide is generally present in the bonded state, such as $Cr_2O_3$—FeO, the indirect reduction is not caused so prominently as in case of an iron ore and it is presumed that only a part of the iron oxide is reduced on the surface of the agglomerates. In this region, the temperature is estimated to be lower than 1200° C. The layer 7 below the region 6 is a direct reduction region of the solid phase-solid phase. This region 7 is an important region in which the effect of the agglomerates is manifested most prominently. The temperature of this region is estimated to be in the range of from 1200° to 1650° C. In this region, the agglomerates still retain substantially their original shape, and in the agglomerates, not only iron oxide but also chromium oxide is reacted and reduced with the carbon in the agglomerates. The reduction product of chromium oxide is composed mainly of a carbide. Since the powdery chromium ore and powdery carbonaceous material are mixed substantially uniformly, and they are closely in contact with each other, the reaction area is large and the reaction is advanced sufficiently. Of course, the reduction is not completed in this region 7. Then, the agglomerates containing unreacted oxides are transferred to a region 8 in which the solid phase, liquid phase and gas phase are co-present. Since this region is near the tuyeres' end, melting of the agglomerates is started in this region. At this point, already reduced iron and chromium are also molten and dropped into the melt reservoir 10, and the unreduced iron and chromium oxides are reduced by the carbonaceous reducing material in the agglomerates or the lumpy coke, and then, are dropped in the melt reservoir 10 among particles of the lumpy coke. Hearth coke is present in the upper portion of the melt reservoir 10 or in the slag layer, and it is assumed that this hearth coke falls in contact with unreacted $Cr_2O_3$ to reduce it.

The Inventors interrupted the operation of the test plant of the blast furnace and investigated the state of the loaded material in the blast furnace. The temperature in the blast furnace was assumed from the specimens sampled at the locations denoted by the mark *o* in FIG. 2.

1. Lump Region

The upper region of the blast furnace, denoted as A in FIG. 2 was a lump region in which the agglomerates retained their forms prior to the charging thereof, while FeO was partially reduced by indirect reduction. The temperature of the lump region, was 1650° C or less.

2. Softening Region

The region of the blast furnace denoted as B in FIG. 2 was a softening region. Since the temperature of the softening region varied from 1700° to 1800° C, the softening of the agglomerates took place. However, this temperature is not so high as to cause the liquefaction and dropping of the agglomerates, if the content of the $Cr_2O_3$ in the agglomerates is high. On the other hand, since the temperature of the softening region exceeds the melting point of the chromium carbide, the reduced chromium liquefies and drops.

Only a slight amount of the non-reduced part of the agglomerates and slag were present in the softening region and no chromium reduced to carbide was present.

It is easily assumed that, if the operation of the blast furnace were further continued, the non-reduced part of the agglomerates, mentioned above, could be further reduced, and then liquefy and drop.

3. Drop Region

The section of the blast furnace denoted as C substantially consisted of the lumpy coke. This is because, all of the metallic material and the slag were dropped down in a liquid state out of the drop region C between the lumpy coke and further, the dropping was completed during the stoppage of the blast furnace operation and the disassembling of the blast furnace.

4. Hearth

The section of the blast furnace denoted as D consisted of the ferrochromium metal and the slag, in which the $Cr_2O_3$ content was less than 5%, as well as a small amount of residual coke. It is, therefore, believed that the coke in the drop region reduces to a considerable extent the chromium oxide in the slag, which is transferred from the softening region in a non reduced state. It is also believed that the residual coke in the hearth further reduces the slightly residual chromium oxide, with the result that the chromium oxide in the slag is finally reduced to a very small amount.

From the state of the charged materials in the blast furnace, as described hereinabove, it is concluded that, in order to ensure the continuous transfer of the loaded materials, it is important to reduce agglomerates to a high in the upper part of the softening region, thereby lowering the viscosity of the slag containing the non reduced, residual $Cr_2O_3$. The reduction degree in the softening region should be 60% or more, preferably 80% or more, based on the weight of the chromium oxides in the chromium ore.

In the process of the present invention, judging from the fact that the yeild of preparing the ferrochromium metal is elevated by charging agglomerates of a chromium ore and a carbonaceous material, it is definite that the reaction in the process of the present invention is considerably different from the reaction in the smelting of a lumpy ore in a blast furnace. Further, judging from the fact that ferrochromium is obtained in a high yeild, it is believed that in the blast furnace, melting and reduction are advanced in a well balanced state.

The present invention will now be described with reference to the Examples set forth below. Compositions of the starting materials used in the Examples are shown in Table 1.

The blast furnace used in the Examples had a configuration as shown in FIG. 1. The blast furnace had a hearth diameter (inner diameter of the furnace bottom) of 1000 mm, a height measured from the tuyeres to the furnace top of 4000 mm and an inner capacity of about 3.2 $m^3$.

EXAMPLE 1

Starting materials illustrated in Table 1 and to be charged in the blast furnace were prepared in the order shown in Table 2.

Table 2

| Step | Conditions |
|---|---|
| Mixing of ore | 100 parts by weight of ore A, 24.2 parts of powdery coke (carbon factor* = 1.0) |
| Pulverization | −150 mesh, 98% |
| Addition of binder | 6.2 parts by weight of bentonite |
| Addition of water | water content of 13–18% |
| Granulation | preparation of conglomerate of 10–25 mm by pan pelletizer |
| Drying | dried at 100 to 500° C by grate kiln |
| Proportions of starting materials charged into blast furnace | 100 parts by weight of pellets, 23.0 parts by weight of lumpy coke 11.5 parts by weight of limestone and 4.8 parts by weight of silica |

Note:
*The carbon factor of 1.0 means that the amount of carbon in the pellet is equal to the sum of the amounts of carbon necessary for the reactions represented by the formulas (1) and (2) given hereinbefore.

With the above proportions of the starting materials, the C/S ratio was 0.5 and AMF was 0.5. The gauge gas pressure of the gas at the top of the blast furnace was 0.1 kg/$cm^2$. The starting materials were charged layer by layer, and the blast temperature was 700° C. An oxygen-enriched air having an oxygen content of 30% by volume was employed and blown at a rate of 10 $m^3$/min per one $m^2$ of the cross sectional area of the blast furnaces inner space at the level of the tuyeres. When the operation was carried out under the foregoing conditions, metallic ferrochromium and slag were obtained in amounts of 38.5 parts by weight and 40.2 parts by weight, respectively. The yield of chromium was 90%. As a result of the analysis, it was found that the metal product was high-carbon ferrochromium comprising 68.7% of Cr, 8.8% of C, 0.8% of Si, 0.01% of S and 0.04% of P with the balance being iron. The manufacturing rate was 3 tons per day.

Table 1

| Starting materials | Analysis results (% by weight) of starting materials | | | | | | | | | | Remarks |
|---|---|---|---|---|---|---|---|---|---|---|---|
| | $Cr_2O_3$ | FeO | $Al_2O_3$ | MgO | $SiO_2$ | CaO | F-C | VM | $Fe_2O_3$ | Cr/Fe | |
| Chromium ore A | 54.6 | 14.5 | 11.9 | 12.0 | 4.2 | 0.4 | — | — | — | 3.3 | |
| Chromium ore B | 44.7 | 25.1 | 14.7 | 11.1 | 2.7 | 0.5 | — | — | — | 1.57 | |
| Powdery coke | — | — | 3.7 | 0.2 | 8.1 | 0.7 | 82.9 | 1.8 | 1.4 | — | |
| Lumpy coke | — | — | 2.8 | — | 5.3 | — | 88.2 | 0.6 | — | — | 30–70-mm in size |
| Limestone | — | — | — | — | — | $CaCO_3$, 98 | — | — | — | — | |
| Silica | — | — | — | — | 97.2 | — | — | — | — | — | 20–40-mm in size |
| Rapid-hardening Portland cement | — | — | 4.9 | 1.3 | 20.9 | 65.6 | — | ignition loss, 0.9 | 2.9 | — | |
| Bentonite | — | — | 12.5 | 1.9 | 75.7 | 1.4 | — | ignition loss, 6.3 | 1.9 | — | |

Note:
"F-C" designates a fixed carbon
"V-M" designates volatile materials

EXAMPLE 2

Starting materials, illustrated in Table 1, to be charged in the blast furnace were prepared in the order shown in Table 3.

Table 3

| Step | Conditions |
|---|---|
| Mixing of ore and coke | 100 parts by weight of ore B, 23.7 parts by weight of powdery coke (carbon factor = 1.0) |
| Pulverization | 100 mesh, 100% |
| Addition of binder and water | 12.4 parts by weight of Portland cement, appropriate amount of water |
| Granulation | granulated into almond-like and briquette-like shapes 30 mm in size by briquette machine |
| Standing | allowed to stand still for 7 days for aging |
| Proportions of starting materials charged into blast furnace | 100 parts by weight of pellets, 15.6 parts by weight of lumpy coke, 9.1 parts by weight of limestone, 3.6 parts by weight of silica |

With the above proportions of the starting materials, the C/S ratio was 1.25 and the AMF was 0.5. The starting materials were charged into the blast furnace layer by layer. The blast temperature was 500° C, the oxygen enrichment ratio was adjusted so that the tuyere end theoretical combustion temperature at the tuyere end was 2400° C. The blast was blown at a rate of 30 $m^3/min/m^2$. The gauge pressure at the top of the blast furnace was 2 $kg/cm^2$. Under the foregoing conditions, the operation was carried out, and as a result, 39.6 parts by weight of the ferrochormium metal and 41.0 parts by weight of the slag were obtained. From analysis it was found that the ferrochromium comprised 55.2% of Cr, 7.9% of C, 0.5% of Si, 0.02% of S and 0.02% of P, with the balance being Fe. The yield of chromium was 95%. The manufacturing rate was 6.5 tons per day.

EXAMPLE 3 (COMPARATIVE EXAMPLE)

In this Example, the briquettes were prepared without incorporating the carbonaceous material thereinto. The starting materials illustrated in Table 1 and to be charged into the blast furnace were prepared according to the order described in Table 4.

Table 4

| Step | Conditions |
|---|---|
| Mixing of ore | 36.3 parts by weight of ore A, 63.7 parts by weight of ore B (the Cr/Fe ratio = 2.0) |

Table 4-continued

| Step | Conditions |
|---|---|
| Pulverization | −150 mesh, 98% |
| Addition of binder | 5 parts by weight of bentonite |
| Addition of water | water content of 9–12% |
| Granulation | preparation of pellets of 10–25 mm by pan pelletizer |
| Drying | dried at 100 to 500° C by grate kiln |
| Proportions of starting materials charged into blast furnace | 100 parts by weight of pellets, 80.0 parts of lumpy coke, 16.0 parts by weight of limestone and 7.9 parts by weight of silica |

With the above proportions of the starting materials, the C/S ratio was 0.5 and the AMF was 0.5. The operation of the blast furnace was performed under the same conditions as those described in Example 1. As a result, the operation of the blast furnace was unsuccessful, because the tapping of melt was not possible at all. After the completion of the operation, the furnace was disassembled. Only a small amount of metal and slag was found in the hearth and, also, some metal was suspended, in the shape of drops, in the slag.

It was impossible to promote the reaction to an extent further than that obtained in this Example.

EXAMPLE 4 (COMPARATIVE EXAMPLE)

In this Example, the lumpy chromium ores having the compositions shown in Table 5 were used.

Table 5

| | $Cr_2O_3$ | FeO | $Al_2O_3$ | MgO | $SiO_2$ | CaO | the weight ratio of Cr/Fe |
|---|---|---|---|---|---|---|---|
| Ore C | 51.8 | 12.7 | 7.6 | 20.0 | 5.6 | trace | 3.59 |
| Ore D | 29.3 | 12.6 | 25.6 | 19.6 | 7.8 | 1.5 | 2.05 |

The proportions of the charged materials were as follows.

Ore C — 35.6 parts by weight
Ore D — 64.4 parts by weight
the weight ratio of Cr/Fe was 2.6
Lumpy coke — 100.0 parts by weight
Limestone — 23.6 parts by weight
Silica — 16.0 parts by weight
AMF was 0.5 and C/S was 0.5

The conditions of the furnace operation were the same as those of Example 1. The operation was unsuccessfully completed, because it was impossible to tap a melt. In addition, almost no metal or slag was found in the hearth of the blast furnace.

What we claim is:

1. Process for producing ferrochromium which comprises:

charging in a blast furnace (a) agglomerates containing a powder of chromium ore and a powder of carbonaceous reducing material and (b) lumpy coke, the ratio of said carbonaceous material in said agglomerates is set so that the minium value of said ratio is in agreement with the amount necessary for reducing an iron ore in the chromium ore according to the formula $$7FeO + 10C \rightarrow Fe_7C_3 + 7CO$$

and the maximum value of said ratio is 1.2 times the amount necessary for reducing the iron oxide and chromium oxide in the chromium ore according to the formulae $$7Cr_2O_3 + 27C \rightarrow 2Cr_7C_3 + 21CO$$

$$7FeO + 10C \rightarrow Fe_7C_3 + 7C0,$$

the slag-forming composition in the charged materials being such that the ratio of $$\frac{\text{CaO (by weight \%) in the slag}}{SiO_2\text{(by weight \%) in the slag}}$$

ranges from 0.4 to 1.3, and further, the ratio of $$\frac{Al_2O_3\text{(\% by weight)} + MgO\text{(\% by weight)}}{CaO\text{(\% by weight)} + SiO_2\text{ (\% by weight)} + MgO\text{(\% by weight)} + Al_2O_3\text{(\% by weight)}}$$

ranges from 0.4 to 0.8;

preheating a gas, selected from the group consisting of air and oxygen-enriched air having an oxygen content lower than 41% by volume, to a temperature from 200° to 1200° C, the airs of said gas containing a moisture content of from 3 to 50 grams per one $m^3$ of said air;

blowing said preheated gas through the tuyeres of said blast furnace at a rate of from 10 to 30 $m^3$/minute per one $m^2$ of the cross-sectional area of the blast furnace at the level of the tuyeres;

adjusting the gas pressure at the top of the blast furnace to a high absolute pressure of from 1 to 3 $kg/cm^2$;

thereby reducing said chromium ore to chromium carbide by said carbonaceous material, at a reduction degeee of more than 80% in a region of the blast furnace where the chromium ore is softened;

melting and dropping said reduced chromium carbide from said softening region to a hearth of said blast furnace; and obtaining a ferrochromium containing more than 40% by weight of chromium and slag containing less than 5% of $Cr_2O_3$ from said hearth.

2. A process for the preparation of ferrochromium according to claim 1, wherein the powder of the chromium ore is composed of particles having a size of 45 mesh or finer, the carbonaceous powder is composed of particles having a size 45 mesh or finer, the size of said agglomerates is in the range of from 10 to 50 mm, the size of the lumpy coke is in the range of from 10 to 100 mm, and the lumpy coke is charged in an amount of 150 to 500 kg per ton of the agglomerates.

3. A process for the preparation of ferrochromium according to claim 1, wherein a slag-forming material is charged into the blast furnace in the form of an additive powder incorporated in the agglomerates and/or in the form of lumps separately from the agglomerates, so as to adjust the composition of the slag.

4. A process for the preparation of ferrochromium according to claim 3, wherein silica, quick lime and/or limestone is charged as the slag-forming material.

* * * * *